US007311584B2

(12) United States Patent
Goff

(10) Patent No.: US 7,311,584 B2
(45) Date of Patent: Dec. 25, 2007

(54) ABRASIVE THROWING WHEEL AND IMPROVED BLADE ASSEMBLY

(75) Inventor: James R. Goff, Coweta, OK (US)

(73) Assignee: Pangborn Corporation, Hagerstown, MD (US)

( * ) Notice: Subject to any disclaimer, the term of this patent is extended or adjusted under 35 U.S.C. 154(b) by 149 days.

(21) Appl. No.: 10/276,270

(22) PCT Filed: Jun. 27, 2001

(86) PCT No.: PCT/US01/20387

§ 371 (c)(1),
(2), (4) Date: Apr. 12, 2004

(87) PCT Pub. No.: WO02/28594

PCT Pub. Date: Apr. 11, 2002

(65) Prior Publication Data

US 2004/0166777 A1 Aug. 26, 2004

Related U.S. Application Data

(60) Provisional application No. 60/236,719, filed on Oct. 2, 2000.

(51) Int. Cl.
*B24B 1/00* (2006.01)
*B24C 1/00* (2006.01)

(52) U.S. Cl. ..... 451/38; 241/275; 451/95; 451/97; 451/98

(58) Field of Classification Search ..... 241/5, 241/275; 451/38, 91, 94, 95, 97, 98
See application file for complete search history.

(56) References Cited

U.S. PATENT DOCUMENTS

| | | | | | |
|---|---|---|---|---|---|
| 2,819,562 | A | * | 1/1958 | Barnes | 451/97 |
| 2,869,289 | A | * | 1/1959 | Gossard | 451/97 |
| 3,197,920 | A | | 8/1965 | Moore et al. | |
| 3,241,266 | A | * | 3/1966 | Bowling, Jr. | 451/97 |
| 3,352,064 | A | * | 11/1967 | De Groot et al. | 451/97 |
| 3,654,736 | A | * | 4/1972 | De Groot | 451/97 |
| 3,872,624 | A | * | 3/1975 | Ramaswamy | 451/98 |
| 3,894,360 | A | | 7/1975 | DeGroot et al. | |
| 3,945,150 | A | * | 3/1976 | Beckner | 451/97 |
| 4,471,583 | A | * | 9/1984 | Carpenter et al. | 451/97 |
| 4,941,297 | A | | 7/1990 | Carpenter | |
| 5,081,801 | A | * | 1/1992 | Fylak | 451/97 |

FOREIGN PATENT DOCUMENTS

| | | |
|---|---|---|
| GB | 2007554 | 5/1979 |
| GB | 2016322 | 9/1979 |
| GB | 2167984 | 6/1986 |

* cited by examiner

*Primary Examiner*—Timothy V. Eley
(74) *Attorney, Agent, or Firm*—Venable LLP; Jeffri A. Kaminski; Ryan M. Flandro

(57) ABSTRACT

A throwing wheel comprising a mounting element having a central axis with a plurality of blades connected to the mounting element. Each of the blades has an inner end, a first portion of the inner end and a second portion of the inner end. A plurality of locking mechanisms is associated with the respective plurality of blades. Each of the locking mechanisms comprises at least one biasing element which biases the blade away from the central axis of the mounting body and connects each of the blades to the mounting element.

28 Claims, 4 Drawing Sheets

ABRASIVE THROWING WHEEL AND IMPROVED BLADE ASSEMBLY

CROSS-REFERENCE TO RELATED APPLICATIONS

This application claims benefit of U.S. Provisional Application 60/236,719, filed Oct. 2, 2000.

BACKGROUND OF THE INVENTION

1. Field of the Invention

The present invention relates generally to new and useful improvements in a rotatable abrading device of the type commonly referred to as centrifugal blasting machines, and more particularly to the throwing wheels and blade assemblies that are used in such machines.

2. Statement of the Prior Art

Centrifugal blasting machines comprising rotors or wheels having a plurality of blades installed thereon have been known in the art for many years. In use, a stream of abrasive particulate material is fed into the path of the rotating wheel from an impeller secured to the throwing wheel. The blades are adapted to receive and throw the abrasive from the periphery of the throwing wheel at an appropriate discharge point in the machine casing at a blasting velocity to strip or clean metal castings or the like. As the blades propel the abrasive material against a work surface, they are sometimes referred to as throwing blades. Due to the action of the abrasive material on the blades, the blades exhibit considerable wear over a period of time. Attempts have been made to fabricate the blades from abrasion-resistant alloys. In other cases, special blade configurations have been employed to minimize the effects of the abrasive material on the blades.

Notwithstanding these attempts to minimize wear and extend the life of the throwing blades, periodic blade removal and replacement is necessary. This maintenance results in a loss of valuable operating time. Furthermore, while the blades must be removable, they must also be held so securely that they will resist the tremendous centrifugal forces exerted on them when the wheel is operating.

Several methods have been proposed for securing the blades in a removable manner to the throwing wheel. One method involves securing the blades to the front side of a wheel disk, usually by means of a bolt or by means of radial grooves in the wheel, frequently of a dove-tail shape. Another method employs two wheel disks that are maintained in spaced-apart relation. Longitudinal narrow edges of the throwing blades are generally inserted into radial grooves arranged in opposing surfaces of the two disks. Auxiliary means, such as bolts, pivotal locking means, eccentrics, set screws, etc. can be employed to secure the blades against radial displacement. Examples of these devices can be found in U.S. Pat. No. 2,819,562, U.S. Pat. No. 3,352,064 and U.S. Pat. No. 3,654,736. In these devices blade replacement is not always easy because the blades "freeze" or become jammed in the grooves in which they are mounted.

Another arrangement is shown in U.S. Pat. No. 3,894,360. In this case, the blades are mounted on brackets having an angular cross-section, and the brackets, in turn, are mounted on the throwing wheel. The rear of each blade is provided with a cast-in insert stud, which is adapted for insertion through an opening in the angular bracket. The stud is provided with a slot adapted to receive a clip, which holds the blade in position on the angular bracket. The only securing means in this arrangement is comprised of the stud and the spring clip. Should either the stud or spring clip fail, such as by the blade wearing thin around the area of the stud, the blade will fly off the wheel.

Another arrangement is shown in U.S. Pat. No. 3,867,791. In this case, the throwing blade is secured to the wheel by means of a blade block, which is mounted on the wheel. Each blade block has a first groove near an inner end of the block and a second groove near an outer end. Each blade includes lugs for insertion in the grooves. There is a centrally disposed impeller that restricts the movement of the blades, particularly in a radial direction. This is accomplished by employing an impeller having a shoulder that contacts the inner end of the blade. While a degree of commercial success has been achieved with this device, the rear of the blade must generally be machined in the area where it contacts the impeller. This adds to the cost of the blades. Additionally, it has been found to be rather difficult to cast the blade of the type disclosed in the patent because of its large cross-sectional area.

A similar arrangement is shown U.S. Pat. No. 4,249,350. A throwing blade is attached to a throwing wheel by means of a blade block. The blade is attached to the blade block along the rear surface of the blade. Bolts are used to mount the blade block securely to the throwing wheel. An abutment means and protrusions are used to secure the blade in place in a chosen rotational direction. During periods when the wheel is not in operation, the blades are held to the blade blocks using locking springs which bias the blade so as to engage the protrusions and the abutment means.

This assembly has also achieved a measure of commercial success, but suffers from the additional costs and increased labor associated with blade block assembly designs. In addition, the rotational direction of the blade is predetermined to be either clockwise or counterclockwise in rotation, requiring direction specific replacement blades for a particular machine. These limitations further increase downtime and costs to the user.

In short, there exists a need in the art for an improved blade and an improved locking assembly for securing the blades to the wheel of a centrifugal blasting machine. The improved blades must be easily removed and replaced without the need for special tools or extensive disassembly of the device.

Preferably, the blades should not be susceptible to "shot freezing" or jamming in position due to fine particulate fouling the mounting mechanism, as is frequently encountered when the blades are installed in grooves in the abrasive blasting machine. The blades should be adapted to fit centrifugal blasting machines now on the market. The locking assembly should securely mount the blades on the throwing disk to prevent movement of the blades, especially in a radial direction. The assembly should be suitable for use with any length and width of blade turning in either direction. The assembly should not require the machining and the close tolerances characteristic of previous devices.

SUMMARY OF THE INVENTION

It is an object of the present invention to provide a novel-blade for use on a blasting wheel in an abrasive blasting machine.

Another object of the invention is to provide a new and novel locking mechanism that allows for quick removal and replacement of worn blades.

A further object of the invention is to provide a unique and non-obvious blade design, which uses a combination of mounting elements at an interface between the throwing wheel and the blade to attach and retain the blade.

An additional object of the invention is to reduce the number of costly, machined parts for the attachment of the blade to the apparatus.

A still further object of the invention is a bidirectional replacement blade.

Additionally, it is an object of the instant invention to provide a blade that is resistant to becoming lodged in the device.

A further aspect of the invention is to provide a blade that can be dissembled from the device without removing any of the other significant internal pieces of the throwing wheel assembly.

A still further aspect of the invention is to provide a blade that requires no tools to install or remove the blades from the device.

The above and other objects and advantages according to the present invention are accomplished by a throwing blade or blades for use on a throwing wheel of a centrifugal blasting machine. Generally, the blade is detachably connected to the throwing wheel by a novel and non-obvious locking mechanism. The blade has an inner end, generally located along the interface between the blade and a mounting element of the throwing wheel. The blade also has an outer end, a forward surface, and a rear surface. Additionally, the blade has an inlet end closest to the inlet of the assembly and an outlet end closest to the outlet of the assembly. The locking mechanism, preferably located on the inner end of the throwing blade, includes a first portion of the inner end of the blade which is adapted to receive a biasing element and a second portion of the inner end of the blade which is adapted to engage the throwing wheel within a runnerhead portion thereof.

More particularly, the preferred embodiment of the invention provides that the first portion of the locking mechanism includes a rigid lug that is adapted to engage a corresponding detent in the periphery of the throwing wheel. The detent acting as a bearing or driving surface for the blade and including a bore machined radially inward towards the center of the throwing wheel. Preferably, the rigid lug also includes a cavity and the biasing element comprises a spring that is adapted to be inserted between the bore and the cavity and extend partially into each. The second portion of the locking element preferably comprises a projection extending toward the outlet end of the blade, which is adapted to engage a corresponding oppositely extending projection on the throwing wheel. The blade is locked in position on the throwing wheel by the locking mechanism when the outwardly extending projection formed on the second portion engages the oppositely extending portion of the throwing wheel and is biased against disengagement by the tension of the biasing element against the first portion in the radial direction.

A further preferred embodiment of the present invention provides, in combination, a throwing wheel and a blade for mounting on the throwing wheel. The blade has an inlet end, an outlet end, an inner end, an outer end, a forward surface and a rear surface. A locking mechanism, located on the inner end of the throwing blade, includes a first portion which is adapted to receive a biasing element and a second portion which is adapted to engage the throwing wheel within a runnerhead portion thereof. Preferably, the first portion of the locking mechanism includes a rigid lug that is adapted to engage a corresponding detent in the periphery of the throwing wheel, such detent acting as a bearing or driving surface for the blade and including a bore machined radially inward towards the center of the throwing wheel. Preferably, the lug includes a cavity and the biasing element comprises a spring, which is adapted to be inserted within the bore and engage the cavity. The second portion of the locking mechanism preferably comprises a projection extending toward the outlet end of the blade which is adapted to engage a corresponding oppositely extending projection on the throwing wheel. The blade is, thus, locked in position on the throwing wheel by such locking mechanism when the projection extending toward the outlet end, formed on the second portion, engages the oppositely extending portion of the throwing wheel, and is biased against disengagement by the tension of the biasing element.

However, it is appreciated that one of ordinary skill in the art may choose to arrange the location of the biasing element in a different position along said blade/throwing wheel interface to achieve the same result. For instance, in an alternative embodiment, a detent may be provided to contain the biasing element at the second portion of the blade and thus the second portion would be biased by the biasing element in a radial direction. The second portion would in turn bias the first portion in a manner that would detachably affix the blade in this alternate embodiment. Thus modifications in the location of the projections, detents and the biasing element are within the purview of the invention.

The present invention also provides, in combination, an abrasive throwing wheel and a plurality of radially extending blades, each of which is secured to the throwing wheel by unique locking mechanism. Each throwing blade has an inner end, an outer end, an inlet end, an outlet end, a forward surface and a rear surface. The locking mechanism, located on the inner end of the throwing blade, includes a first portion which is adapted to receive a biasing element and a second portion which is adapted to engage the throwing wheel within a runnerhead portion thereof. Preferably, the first portion of the locking mechanism includes a rigid lug that is adapted to engage a corresponding detent in the periphery of the throwing wheel, such detent acting as a bearing or driving surface for the blade and including a bore machined radially inward towards the center of the throwing wheel. Preferably, the lug includes a cavity and the biasing element comprises a spring, which is adapted to be inserted within the bore and engage the cavity. The second portion of the locking mechanism preferably comprises a projection extending toward the outlet end of the blade which is adapted to engage a corresponding oppositely extending projection on the throwing wheel. The blade is, thus, locked in position on the throwing wheel by such locking mechanism when the projection extending toward the outlet end, formed on the second portion, engages the oppositely extending portion of the throwing wheel, and is biased against disengagement by the tension of the biasing element.

Also provided by this invention is an improved rotatable, centrifugal, abrasive throwing device comprising a driven wheel and a plurality of radially extending blades, each of which is secured to the throwing wheel by corresponding locking mechanism. Each of the blades has an inlet end, an outlet end, a front surface and a rear surface. Additionally, each throwing blade has an inner end and an outer end, the inner end engaging the device along an interface with the wheel. The locking mechanism, located on the inner end of the throwing blade, includes a first portion which is adapted to receive a biasing element and a second portion which is adapted to engage the throwing wheel within a runnerhead portion thereof. Preferably, the first portion of the locking mechanism includes a rigid lug that is adapted to engage a corresponding detent in the periphery of the runnerhead, such detent acting as a bearing or driving surface for the blade and including a bore machined radially inward towards the center of the throwing wheel. Preferably, the riser lug includes a cavity and the biasing element comprises a spring, which is adapted to be inserted within the bore and engage the cavity. The second portion of the locking mechanism comprises a projection extending toward the outlet end of the blade, which is adapted to engage a corresponding oppositely extending projection on the runnerhead. The blade is, thus, locked in position on the runnerhead by such locking mechanism when the projection extending toward the outlet end, formed on the second portion, engages the oppositely extending portion of the throwing wheel, and is biased against disengagement by the tension of the biasing element.

The blade, preferably, is provided with spaced longitudinally extending sidewalls that flare away from the inlet end of the blade at an angle preferably in the range of 2 to 7 degrees. Abrasive material fed to the inlet end during operation of the blasting wheel spreads transversely off the blade at a controlled rate of flow resulting in even distribution of abrasive along the entire face of the blade. However, any angle of the blade may be used, even one in which has no flare to its edges, e.g. is parallel to and spaced from the runnerhead.

The instant invention also provides for a throwing wheel device comprising means for mounting a plurality of blades the means for mounting rotating about a co-extensive central axis, together with the plurality of blades. The plurality of blades being detachably affixed to the means for mounting and each of the blades having an inner end, a first portion of said inner end and a second portion of said inner end. The device also includes a plurality of means for affixing each of the plurality of blades to the mounting element. The affixing means having a means for biasing said blades away from the central axis of the mounting body and thereby affixing the blades.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

DETAILED DESCRIPTION OF THE DRAWINGS

Figure 1:
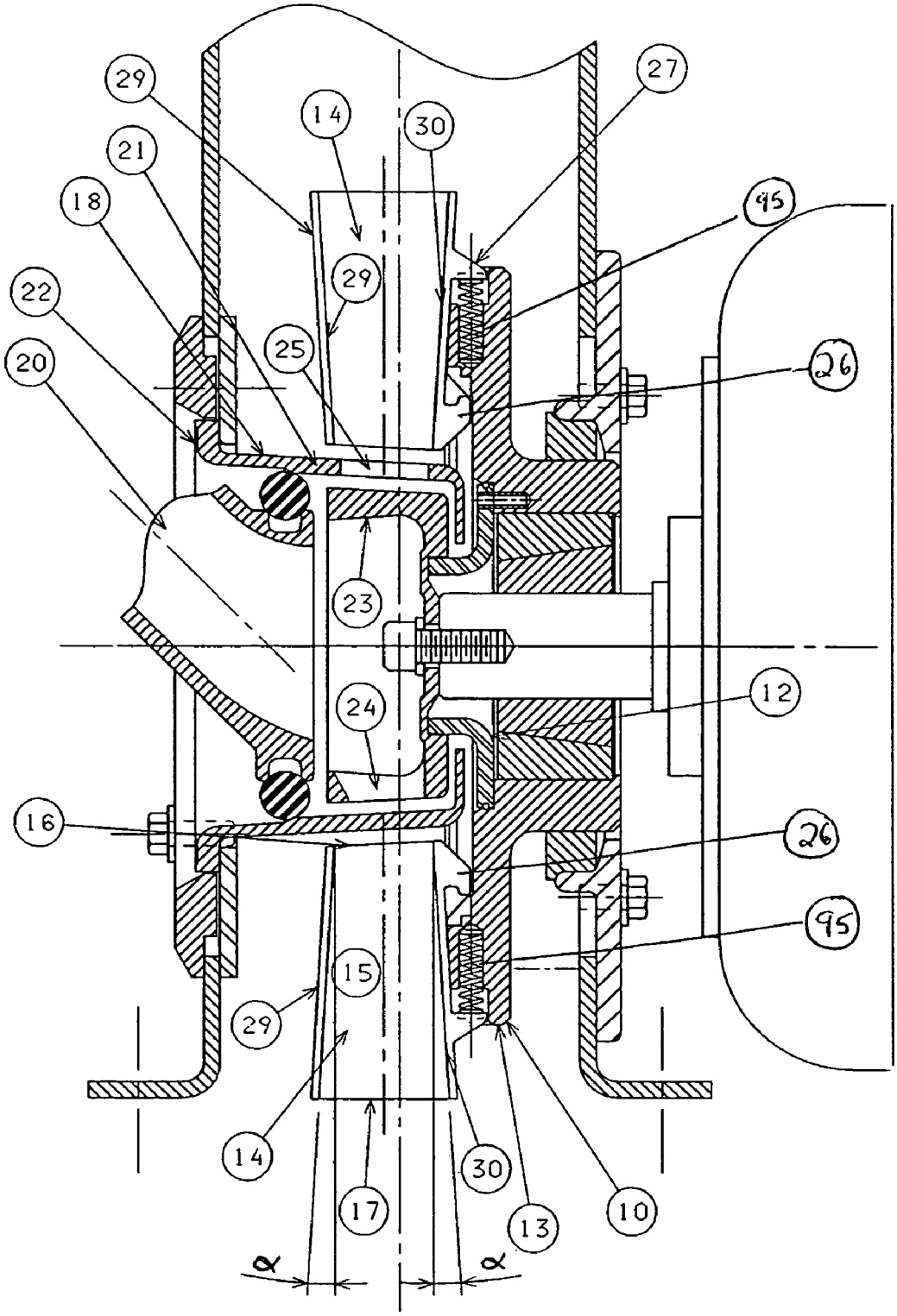
FIG. 1 is a partial sectional view of a centrifugal blasting machine, illustrating a throwing blade according to a first embodiment of the present invention.

Referring now to the drawings, wherein like reference characters and numerals refer to like or corresponding parts throughout each of the several views, there is shown in FIG. 1 a throwing wheel assembly 10 of an abrasive blasting machine. Assembly 10 includes a central hub or rotor 12 to which is affixed a runnerhead 13 having a common axis therewith. A plurality of blades 14, preferably curved blades, are perpendicularly mounted on the face of runnerhead 13 and extend generally radially from the axis of rotation of rotor 12. An innermost inlet end 16 of each blade 14 is spaced a distance from the axis of rotation for receiving particulate abrasive material from an impeller 23.

Impeller 23 is disposed on the hub 12 between the inlet ends 16 of blades 14 for feeding the abrasive particles which are received from a fixed spout 20 to blades 14 in a usual manner. The impeller case 21 comprises an open-ended flange 22 connected to the machine casing and open to the spout 20. An impeller 23 is disposed within case 21 and is rotatably affixed to hub 12. Impeller 23 is provided with openings 24 for discharging abrasive received from spout 20 outwardly of case 21 through a discharge opening 25 therein upon rotation of wheel 10. In this manner abrasives are fed to the inlet ends 16 of blades 14 as blades 14 rotate past the opening 25. The abrasive is then moved along the face 15 of the blade from the inlet end 16 to the outlet end 17 for discharge therefrom at a selected blasting velocity.

This description is of the preferred embodiment of a throwing wheel assembly. It is to be understood that the structure thus far described refers to conventional structure as found in known blasting wheel devices and that the present invention, which is to be hereinafter described in further detail, is not limited to the particular device shown. The invention would work equally well in any of the throwing wheels disclosed above. The drawings have been simplified to show only such conventional parts of wheel assembly 10 as are necessary for a clear understanding of the present invention.

Figure 3:
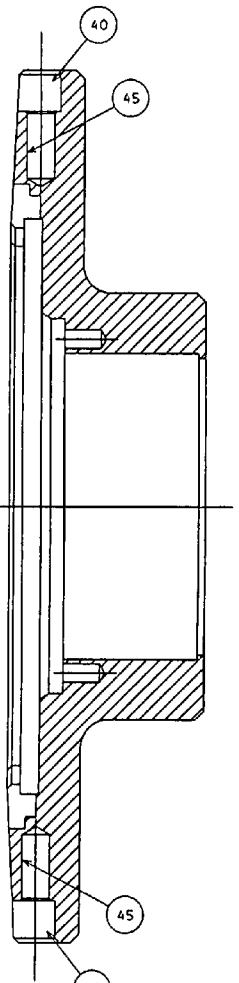
FIG. 3 is a sectional view of the throwing wheel taken along the line I-I of FIG. 2.
Figure 2:
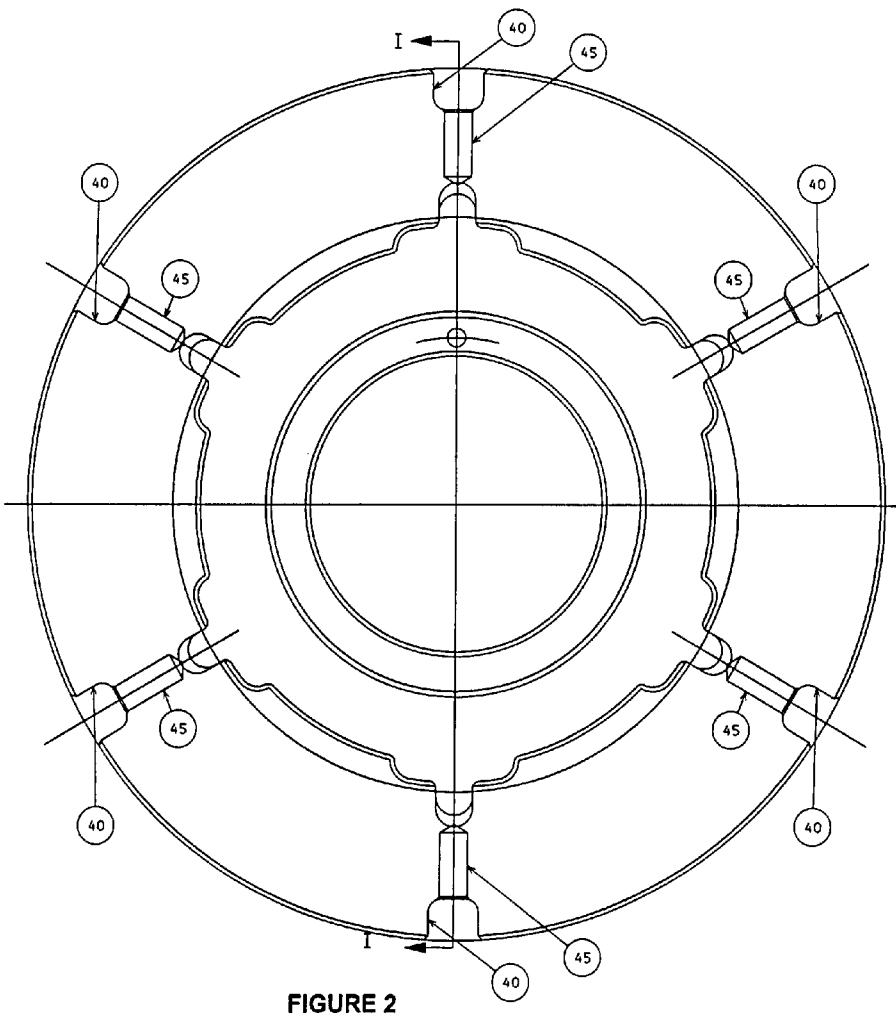
FIG. 2 is a cross-sectional front elevational view of the throwing wheel shown in FIG. 1.

As mentioned, it is the feature object of the present invention to provide a blade 14 of novel configuration for quick and easy removal from the throwing wheel in the most efficient way possible with a minimum of complex removable parts. Referring to FIGS. 2 and 3, there is shown in greater detail the throwing wheel 10 according to the present invention. Wheel assembly 10 includes a plurality of radially-disposed, circumferentially-spaced detents 40, each of which have a corresponding bore 45 formed radially inward therefrom, which are adapted to receive a biasing element (shown in FIGS. 1 and 5) for locking a blade 14 in place.

Like the blades 14 shown in FIG. 1, each blade 14 has an inner end 30, an outer end 29, a front surface 15 and a rear surface 9, an inlet end 16 and outlet end 17. Blades having flared inner and outer surfaces 29, 30 having a flare angle $\alpha$, such as those shown, are preferred. The flare angle $\alpha$ is generally in the range of 2-7 degrees. However, straight blades can be used with equal success in the instant invention. A locking mechanism, located on the inner end 30 of the throwing blade 15, includes a first portion 27 which is adapted to receive a biasing element 95 and a second portion 26 which is adapted to engage the throwing wheel 10 within a runnerhead portion thereof.

Figure 5:
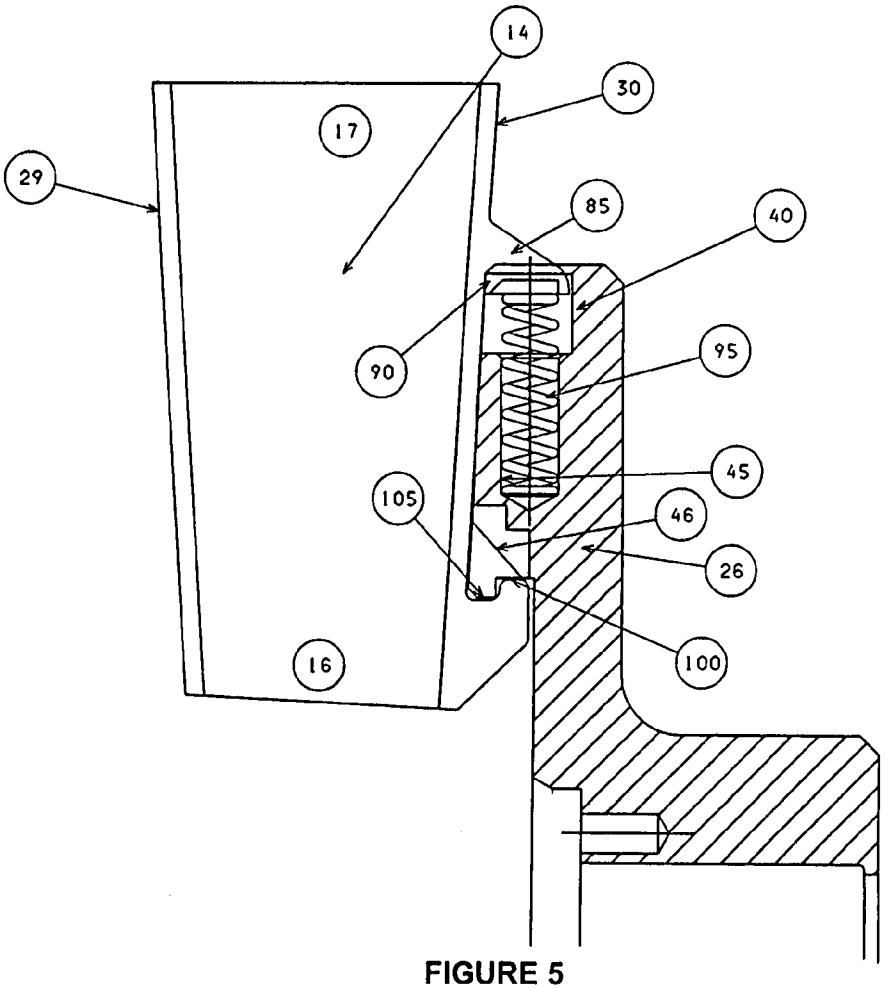
FIG. 5 is a sectional view of the throwing wheel taken along the line II-I of FIG. 4, illustrating the installation of a novel throwing blade assembly according to a second embodiment of the present invention.
Figure 4:
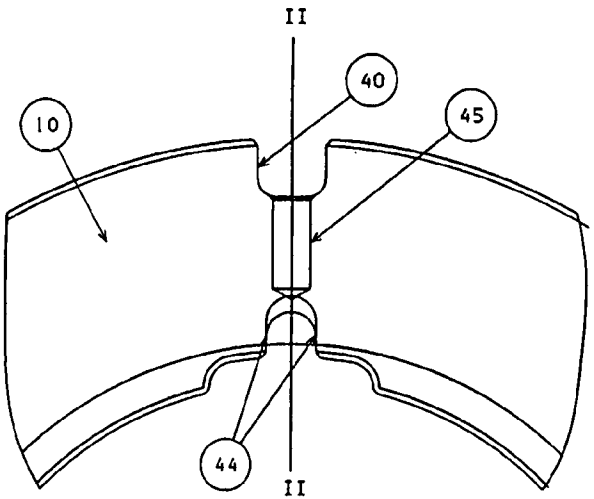
FIG. 4 is an enlarged partial cross-sectional front elevational view of the throwing wheel shown in FIG. 1.
Figure 6:
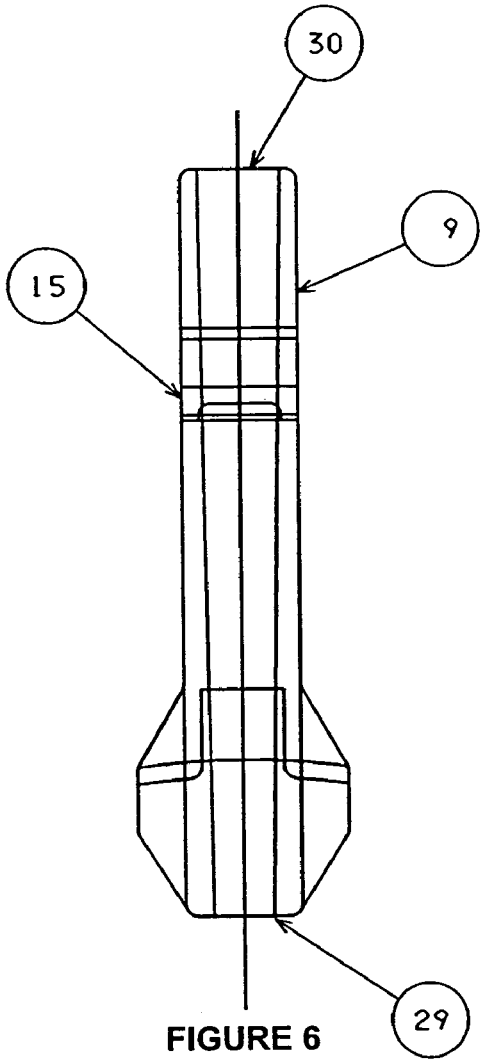
FIG. 6 is a front elevational view of the throwing blade shown in FIG. 5.
Figure 7:
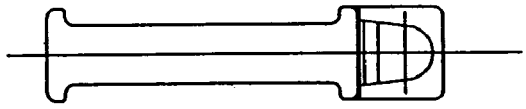
FIG. 7 is a top view of the throwing blade of FIG. 5.
Figure 8:
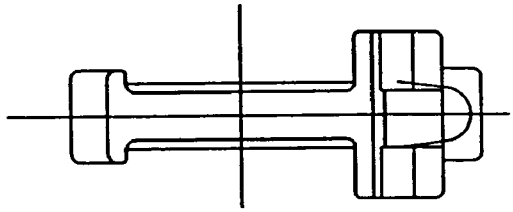
FIG. 8 is a bottom view of the throwing blade shown in FIG. 5.

As shown in FIG. 5, preferably, the first portion 27 of the locking mechanism includes a rigid lug 85 that is adapted to engage a corresponding detent 40 in the periphery of the throwing wheel, such detent 40 acting as a bearing or driving surface for the blade 14 and including a bore 45 machined radially inward towards the center of the throwing wheel 10. Preferably, the rigid lug 85 includes a cavity 90 and the biasing element 95 comprises a spring which is adapted to be inserted within the bore 45 and engage the cavity 90. The bottom or second portion 26 of the locking mechanism comprises a projection extending toward the outlet end of the blade 100 which is adapted to engage a corresponding oppositely extending projection 105 on the throwing wheel 10. The blade is also biased by the gusset 46 on the back side of the blade and surface 44 on the runnerhead. The blade 14 is, thus, locked in position on the throwing wheel by such a locking mechanism when the projection extending toward the outlet end, formed on the second portion, engages the oppositely extending portion of the throwing wheel 10, and is biased against disengagement by the tension of the biasing element 95.

As shown in the Figures, the preferred embodiment of the device using the novel blade configuration is assembled by aligning the biasing element 95, preferably a spring, with cavity 90 of the rigid lug 85. The rigid lug 85 is urged against the force of the spring 95 toward the center of the throwing wheel. The projection extending toward the outlet end of the blade 100 is moved forward during this action until it is in aligned with the corresponding oppositely extending projection 105 on the throwing wheel 10. The projections are aligned and the spring 95 is released. Thus the spring urges the projection 100 into forcible engagement with the oppositely extending projection 105, with the rigid lug 85 being aligned with the spring 95, which is held by cavity 90. The blade is biased in the radial direction, the direction of the centrifugal force, by spring 95 and maintains engagement of the blade 14 with the throwing wheel assembly 10. During operation, the projection 100 is further urged into forcible engagement with the oppositely extending projection 105 by the rotation of the device. Even if the first portion of the locking mechanism should fail during operation, the instant invention has an added safety feature in that the second portion of the instant invention would continue to maintain engagement with the throwing wheel.

While this invention has been described in connection with a centrifugal blasting machine comprised of a single wheel disk, it will be understood that two or more wheel disks, maintained in spaced apart relation, can also be employed without departing from the spirit of the invention.

There are a number of advantages associated with this invention. First of all, means are provided for rigidly securing a throwing blade to a blasting wheel. Movement of the blades in a radial direction, even if the locking mechanism fails, is substantially prevented making for a very safe device. The blades can be removed easily and quickly replaced. Special assembly and disassembly tools are not required and further costly machined parts are unnecessary. While the device of this invention can employ blades inserted in grooves in the throwing wheel, the use of such grooves is not necessary and will generally be avoided since blades frequently become wedged or frozen in such grooves. Lost production time is minimized because of the ease and speed with which blades can be serviced or replaced. It is not necessary to remove any of the internal parts in the centrifugal blasting machine to replace the blades according to this invention. It has been found that the blades can be fabricated using less metal than required to fabricate blades of the type described in U.S. Pat. No. 3,867,791. Furthermore, utilizing the instant invention saves the material, manufacturing, and replacement costs of the blade block. The locking design of this invention can be adapted to any length or width of blade.

The invention as is described herein in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. A throwing wheel apparatus comprising:

a means for mounting an element, said means for mounting having a central axis;

a plurality of blades detachably affixed to said means for mounting; and a plurality of means for affixing each of said plurality of blades to said means for mounting, wherein the affixing means further comprises a means for biasing said blades away from the central axis of the means for mounting.

2. An apparatus comprising:

a mounting element having a central axis of rotation;

a plurality of blades detachably connected to said mounting element, each blade of said plurality of blades having an inner end and an outer end, the inner end including a first portion and a second portion; and a like plurality of locking mechanisms associated with the respective plurality of blades, wherein each of the locking mechanisms includes at least one biasing element for biasing said blade away from the central axis of the mounting element to detachably connect each of said blades to said mounting element along said inner end, wherein said mounting element further comprises a detent, wherein said mounting element further comprises a bore extending inward from said detent toward the central axis of said mounting element and into which said biasing element is received.

3. The apparatus of claim 2, wherein said first portion further comprises a rigid lug and a cavity in said rigid lug aligned with said detent, said biasing element being held therebetween.

4. A method of attaching a blade having a biasing element, a first portion and a second portion to a throwing wheel with a mounting element comprising the steps of:

compressing the biasing element with the first portion of the blade to urge the second portion towards the mounting element;

engaging the second portion of the blade with the mounting element; and releasing the biasing element from compression to detachably affix the blade to the throwing wheel.

5. The method of claim 4, wherein the second portion of the blade is a first extension and the mounting element is a runner head with a second extension, and the method step of engaging includes engaging the first extension from the blade with the second extension in the runnerhead.

6. A replaceable blade attachable to a throwing wheel assembly, the replaceable blade comprising:

an outer end; and an inner end located on an opposite side of the replaceable blade relative to said outer end, said inner end being directly attachable to the throwing wheel assembly, said inner end comprising:

a first portion engageable with a biasing element disposed in the throwing wheel assembly; and a second portion spaced apart from said first portion, said second portion comprising:

a gusset; and a blade projection positioned on both sides of said gusset, said gusset and said blade projection being coupleable with a projection on the throwing wheel assembly, wherein tension between the biasing element engaging said first portion biases said second portion against disengagement from the projection.

7. The replaceable blade of claim 6, wherein said first portion is a rigid lug.

8. The replaceable blade of claim 7, wherein said rigid lug has a cavity and the biasing element engages the rigid lug at the cavity.

9. The replaceable blade of claim 6, further comprising:

an inlet end; and an outlet end.

10. The replaceable blade of claim 9, wherein said inner end and said outer end of the blade extend at an angle from said inlet end to said outlet end.

11. The replaceable blade of claim 10, wherein the angle from said inlet end to said outlet end is about 2 to 7 degrees.

12. The replaceable blade of claim 9, wherein said inner end and said outer end are parallel with one another from said inlet end to said outlet end.

13. The replaceable blade of claim 9, wherein said first portion is proximate to said outlet end.

14. The replaceable blade of claim 9, wherein said second portion is proximate to said inlet end.

15. The replaceable blade according to claim 6, wherein the replaceable blade is adapted to receive abrasive material when attached to the throwing wheel assembly rotating about an axis in a first rotational direction or a second rotational direction.

16. An apparatus comprising:

a mounting element having a central axis of rotation;

a plurality of blades according to claim 6 directly connected to said mounting element, wherein each of said plurality of blades detachably connect to said mounting element at respective inner ends by engagement of respective biasing elements disposed in said mounting element with respective first portions and by engagement of projections with respective second portions, wherein said biasing elements respectively bias said plurality of blades away from the central axis of rotation.

17. The apparatus of claim 16, wherein said biasing elements respectively engage both said first portions and said mounting element.

18. The apparatus of claim 16, wherein said mounting element further comprises a detent.

19. The apparatus of claim 18, wherein said mounting element has a bore (45) extending inward from said detent toward the central axis of rotation, said mounting element having one of said biasing elements positioned within the bore.

20. The apparatus of claim 16, wherein said projections extend toward the central axis of rotation of said mounting element.

21. The apparatus of claim 20, wherein each of said blade projections extend away from the central axis of rotation of said mounting element.

22. The apparatus of claim 16, wherein for each of said plurality of blades attached to said mounting element, said first portion is positioned farthest from the central axis of rotation relative to said second portion.

23. The apparatus of claim 16, wherein for each of said plurality of blades attached to said mounting element, said second portion is positioned nearest to the central axis of rotation relative to said first portion.

24. The apparatus of claim 16, wherein each of said biasing elements is a spring.

25. The apparatus of claim 16, wherein said mounting element further comprises a central hub and a runner head.

26. A centrifugal abrasive throwing machine comprising:

the apparatus of claim 16;

a spout for supplying abrasive particulate to the apparatus;

an impeller coupled to said spout, said impeller being adapted to receive the abrasive particulate from said spout and to provide the abrasive particulate to the apparatus; and means for driving the apparatus and said impeller.

27. A method of abrading a workpiece comprising the steps of:

supplying an abrasive particulate to the apparatus of claim 16;

accelerating the particulate; and directing the particulate at the workpiece.

28. A method for directly attaching a replaceable blade to a throwing wheel assembly comprising:

compressing a biasing element disposed in the throwing wheel assembly with a first portion of the replaceable blade to move a second portion of the replaceable blade toward a projection of the throwing wheel assembly, said first portion and said second portion being positioned on an inner end of the replaceable blade, said second portion comprising a gusset and a blade projection positioned on both sides of said gusset;

engaging said second portion with the projection of the throwing wheel assembly; and releasing said biasing element from compression to detachably affix said inner end to the throwing wheel assembly.

* * * * *